US006430786B1

(12) United States Patent
Ikeda et al.

(10) Patent No.: US 6,430,786 B1
(45) Date of Patent: Aug. 13, 2002

(54) SYNTHETIC RESIN OPENING AND CLOSING PRESS FASTENER

(75) Inventors: Hiroki Ikeda, Oosaka; Masaaki Fuda; Toshiaki Takizawa, both of Toyama, all of (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/662,841

(22) Filed: Sep. 15, 2000

(30) Foreign Application Priority Data

Sep. 16, 1999 (JP) ..... 11-261615

(51) Int. Cl.[7] ..... A44B 1/00; A44B 17/00; A44B 18/00

(52) U.S. Cl. ..... 24/444; 24/104; 24/114.9; 24/306; 24/442

(58) Field of Search ..... 24/444, 442, 446, 24/306, 104, 114.9, 682.1

(56) References Cited

U.S. PATENT DOCUMENTS

| | | | | |
|---|---|---|---|---|
| 2,748,517 A | * | 6/1956 | Berkis | 24/104 |
| 3,031,730 A | * | 5/1962 | Morin | 24/306 |
| 3,094,757 A | * | 6/1963 | Blake | 24/265 R |
| 3,403,429 A | * | 10/1968 | Smith | 24/306 |
| 3,405,408 A | | 10/1968 | Baker | |
| 3,851,357 A | * | 12/1974 | Ribich et al. | 24/104 |
| 4,541,154 A | * | 9/1985 | Ito et al. | 24/442 |
| 5,048,160 A | * | 9/1991 | Goodrich et al. | 24/306 |
| 5,282,616 A | * | 2/1994 | Stacavich-Notaro | 24/306 |
| 5,515,583 A | * | 5/1996 | Higashinaka | 24/446 |
| 5,655,268 A | * | 8/1997 | Keyaki et al. | 24/442 |
| 6,314,622 B1 | | 11/2001 | Takizawa et al. | |

FOREIGN PATENT DOCUMENTS

| | | |
|---|---|---|
| GB | 2 329 216 | 3/1999 |

* cited by examiner

*Primary Examiner*—Victor Sakran
(74) *Attorney, Agent, or Firm*—Finnegan, Henderson, Farabow, Garrett & Dunner L.L.P.

(57) ABSTRACT

A synthetic resin opening and closing press fastener comprises a front side flat plate portion and a rear side flat plate portion which are attached to the end edges of a flat plate shaped attached body. One end of these portions are connected by means of a connecting portion that is a positioning portion of the end edge of the attached body, and has a number of male engaging elements of a surface fastener on the rear face of the rear side flat plate portion. In order to attach this opening and closing press fastener to the attached body, the fastener attaching end edge of the attached body is inserted from an open end of the front and rear side flat plate portions of the press fastener. When the above end edge abuts against the connecting portion, both of the flat plate portions are connected to each other via the attached body by means of synthetic resin pin members having at least engaging heads at one end. In addition, the engaging heads are attached to be removably engaged with engaging holes of the counterpart flat plate portion. In this way, there is provided a synthetic resin press fastener capable of being easily and exactly attached to the attached body such as clothes; facilitating release operation of the fastener irrespective of thickness and ensuring smoothness; and moreover, being free from an excessive force to the attached body by an external force caused during the release operation and ensuring high durability and cost reduction.

10 Claims, 8 Drawing Sheets

SYNTHETIC RESIN OPENING AND CLOSING PRESS FASTENER

BACKGROUND OF THE INVENTION

1. Field of the Invention

The present invention relates to a synthetic resin opening and closing press fastener employed in place of a conventional snap button or a general button.

2. Description of the Related Art

Conventionally, a synthetic resin opening and closing press fastener of this type has been proposed by the Applicant in Japanese Patent Laid-open Publication No. 9-75113. The fastener is composed of an integrally molded product having substantially U Shape cross section, in which one end of each of thermoplastic resin based flat plate portions of the same shape substantially parallel to each other are connected by means of a connecting portion. A number of male engaging elements are molded to stand on one flat plate portion surface sandwiching said connecting portion, and a pinch piece protruded from the connecting portion outwardly is molded in parallel to the flat plate portions. In addition, a groove shaped sewing line is formed along the entire peripheral edge of each of the two flat plate portion surfaces.

In this opening and closing press fastener, a product with its stable shape and sophistication having its shape and pattern can be provided at its low cost by means of a single molding process. Moreover, an attaching end edge of clothes is abutted against inside of the connecting portion, whereby the fastener can be attached to the clothes or the like, and its positioning is facilitated.

Hence, in the opening and closing press fastener, it is required to mold the thickness of each flat plate portion as thinly as possible in order to ensure the flexibility of clothes or the like. As described previously, however, a further thin sewing line is formed along the entire peripheral edge, and thus, the fastener is easily broken at that portion. Thus, there is a limitation to thinning the thickness of the flat plate portion. Further, as its thickness is thinner, it becomes more difficult to ensure that the contour of the flat plate portions are coincident with one another when two flat plate portion is set to the end edge of clothes. Thus, the sewing line formed at both flat plate portions is often shifted, making it difficult to ensure exact sewing along the sewing line.

Even if the thickness of each flat plate portion is minimized in order to cope with such problem, when the fastener is attached to the end edge of clothes or the like, the end edge of clothes is sandwiched by two flat plate portions at its attaching portion, and the portion is extremely increased in rigidity. There should be no remarkable problem because closing operation will be done by merely pressing the portion. In particular, during opening operation, unless opening operation is performed pressing the male surface fastener member of the counterpart until the releasing has been completed, both of the fastener-members move together with their overlapped portion, and smooth opening operation cannot be performed. This is because, when the surface fastener is engaged/disengaged, in particular, when its engagement is released, it is difficult to remove a full face at one time. That is, this is due to an engaging/disengaging operation specific to the surface fastener that one surface fastener member must be turned up to be disengaged.

Further, since the flat plate portion on a front side of clothes is sewed all over the entire peripheral edge, during the aforementioned opening operation, there occurs a problem that a shearing force acts to a sewing yarn sewed orthogonal to an opening operation direction so that and the sewing yarn breaks due to the repeated opening operation. The most difficult point in handling of this opening and closing press fastener is as follows. Two flat plate portions are composed of the same flat shape. When these flat plate portions are sewed to the end edge of the attaching portion of clothes, it is required to do complicated work that two flat plate portions are opened respectively to the outside with the connecting portion being center thereof, and the end edge of the attaching portion of clothes is inserted into its opening.

An opening and closing press fastener modified in order to solve such problem is proposed in Japanese Patent Application No. 10-366749, for example, by the same Applicant. That is, this modified opening and closing press fastener has two portions, i.e., first and second thermoplastic synthetic resin flat plate portions substantially parallel to each other, one end edge being connected to another via the connecting portion, and is integrally molded so that the cross section is formed in a substantially J shape. A number of engaging elements are formed to stand on a surface of the first flat plate portion having a large surface area, and a groove shaped sewing line is formed along its full peripheral edge. A groove shaped sewing line is formed corresponding to part of the sewing line formed at the first flat plate portion, ends of which are opened, on the surface of the second flat plate portion having a small surface area.

According to this press fastener, one of the two flat plate portions connected each other via the connecting portion is formed to be short in length, and thus, the end edge of clothes can be easily inserted between the two flat plate portions without opening two flat plate portions during sewing. In addition, though the groove shaped sewing line is formed along the entire peripheral edge of the first flat plate portion having the large surface area, at the other second flat plate portion with its small surface area, the transverse U shaped groove shaped sewing line of which the ends at an end edge opposite to the connecting portion are opened is merely formed at a corresponding position so as to be partially superimposed with the sewing line formed in the first flat plate portion. Thus, the shifting between the sewing lines of the first and second flat plate portions is reduced, and the sewing along the sewing line is surely achieved. In addition, on the front side of clothes, sewing is directly made on the clothes after sewing of the second flat plate portion. Thus, unlike the fastener disclosed in the publication, the excessive force in the shearing direction caused by the flat plate portion is not applied to the sewing yarn on the second flat plate portion side, and the sewing yarn is not broken.

And the first flat plate portion having large surface area is arranged on the rear side at the fastener attaching site of clothes, and the second flat plate portion having small surface area is arranged on the front side of clothes. Thus, in view of appearance, the rigidity at the attaching site is substantially eliminated, and the visibility is increased. Further, even if the thickness of the flat plate portion is somewhat increased, required flexibility can be ensured, and opening operation of the fastener is performed smoothly.

However, in the fixing fastener disclosed in the above publication and the fixing fastener according to the above application, the fixing fastener is attached to the attached body by means of sewing. The sewing work is cumbersome and once the fixing fastener is attached to the attached body, the fixing fastener cannot be removed from the attached body unless the sewing yarn is cut, and the-fastener cannot be replaced easily. Further, the required minimum thickness is provided at the first and second flat plate portions in order to prevent the strength from being lowered due to sewing. In view of flexibility, the rigid feeling cannot be eliminated.

SUMMARY OF THE INVENTION

It is an object of the present invention to provide a synthetic resin fixing fastener capable of ensuring easy attaching to its attached body while utilizing the advantages of the foregoing synthetic resin fixing fastener, and capable of being easily replaced with another one.

According to the present invention, there is provided a synthetic resin opening and closing press fastener comprising: a front side flat plate portion and a rear side flat plate portion which are to be attached to an end edge of a flat plate shaped attached body, a positioning portion of the end edge of the attached body being provided on a part of the press fastener; and a number of engaging elements of a surface fastener on a rear side, wherein the opening and closing press fastener is attached to the attached body by means of a synthetic resin pin member having an engaging head at least at one end.

A conventional press fastener of this type has been attached to its attached body by means of sewing using the sewing yarn. The present invention is primarily featured in that the press fastener is attached to the attached body by means of a synthetic resin pin member by a simple operation. That is, when the fastener attaching end edge of the attached body is inserted from an opening end of the front and rear side flat plate portions of the press fastener, and the end edge abuts against a connecting portion that is a positioning portion, an engaging pin connects both of the flat plate portions via the attached body. In addition, the engaging head formed at a free end of the pin is removably attached to at least one engaging portion of both of the flat plate portions, and thus the attaching is completed.

Preferably, the front and rear side flat plate portions are integrally molded via the positioning portion. Alternatively, the front and rear side flat plate portions are separate from each other. When the front and rear side flat plate portions are integrally molded via the positioning portion, the flat plate portion of each of the front and rear sides have to have the same color. However, if the above plate portions are separate from each other, each flat plate portion can be arbitrarily selected, and a variety of uses can be achieved in view of appearance and design in accordance with preference.

Preferably, the pin member is molded to protrude integrally with an inner face of the front side flat plate portion or the rear side flat plate portion toward an inner surface of the flat plate portion of the counterpart. Further preferably, a surface area of the front side flat plate portion is set to be smaller than that of the rear side flat plate portion, and the pin member is molded integrally with a rear face of the rear side flat plate portion at a position out of the front side flat plate portion toward the front side.

When a fastener attaching end edge such as clothes is inserted between the flat plate portions on the front and rear surface sides of the press fastener by employing the aforementioned construction, the press fastener is formed to have substantial J shape in section, and the fastener attaching end edge such as clothes can be easily inserted without widening its opening end. Moreover, its attaching end edge is abutted against the positioning portion, whereby the attaching condition and position of the press fastener is automatically determined, and thus, the press fastener can be attached neatly. Further, a pinch piece extending outwardly from the positioning portion is provided, thus improving the durability and opening and closing operability of the press fastener.

Alternatively, the pin member is separate from the front and rear side flat plate portions, and an engaging head is provided at both ends thereof. Although the engaging head of both ends may be formed from the start. It may be formed at one end. While the fastener attaching end edge of the attached body is sandwiched between the front and rear side flat plate portions of the press fastener, an end on one side of the pin member on which its engaging head is not formed is inserted through the front and rear side flat plate portions via the attached body, and thereafter, the engaging head may be formed by deforming the end to be softened by heating or ultrasound.

Preferably, the number of the engaging elements are formed on the surface of the rear side flat plate portion. Also preferably, a flat plate shaped press fastening portion substantially parallel to the front and rear side flat plate portions extending from the positioning portion to the outside is provided to the fastener, and a number of the engaging elements are formed on the rear side of the press fastening portion.

In the former case, when an attempt is made to engage the number of engaging elements with the engaging elements of the counterpart, this engagement is made by pressing two flat plate portions while the attached body is sandwiched between these flat plate portions. Thus, sufficient engagement may not be obtained as long as these flat plate portions are strongly pressed intentionally. In the latter case, the engagement can be done by pressing one plate-shaped press fastening portion. In comparison with the former case, even if the pressing force is small, these portions can be reliably engaged with each other.

In addition, in the former case, when the fly of clothes is opened, the opening operation force acting to an engagement face directly acts to the attached body sandwiched between both of the flat plate portions on the front and rear sides. Thus, the attached body may be damaged. In the latter case, a majority of the force caused during opening operation acts only to the press fastening portion, and the damage of the attached body due to the opening operation is reduced, and the durability is improved.

Further preferably, the engaging element is made of synthetic resin, and is molded integrally with the opening and closing press fastener, and high productivity and low manufacturing cost can be achieved. However, the rigidity of the male engaging elements is felt, and slight noise occurs during release from the engaging member of the counterpart. Alternatively, the engaging elements are obtained by cutting part of a loop made of a monofilament woven and knitted at the foundation structure during weaving and knitting, and the foundation structure is securely fixed to the opening and closing press fastener. The above described male engaging elements of the opening and closing press fastener are composed of a monofilament woven or knitted in the woven fabrics or knitted fabrics, at the time of weaving or knitting. Thus, the cost per product unit of the surface fastener member is increased, and further, the number of processes for bonding the surface fastener to a predetermined position of the press fastener is increased. Thus, the manufacturing cost is inevitably increased. However, there is provided a superior sense of touch because of its high flexibility.

PREFERRED EMBODIMENTS OF THE INVENTION

Figure 1:
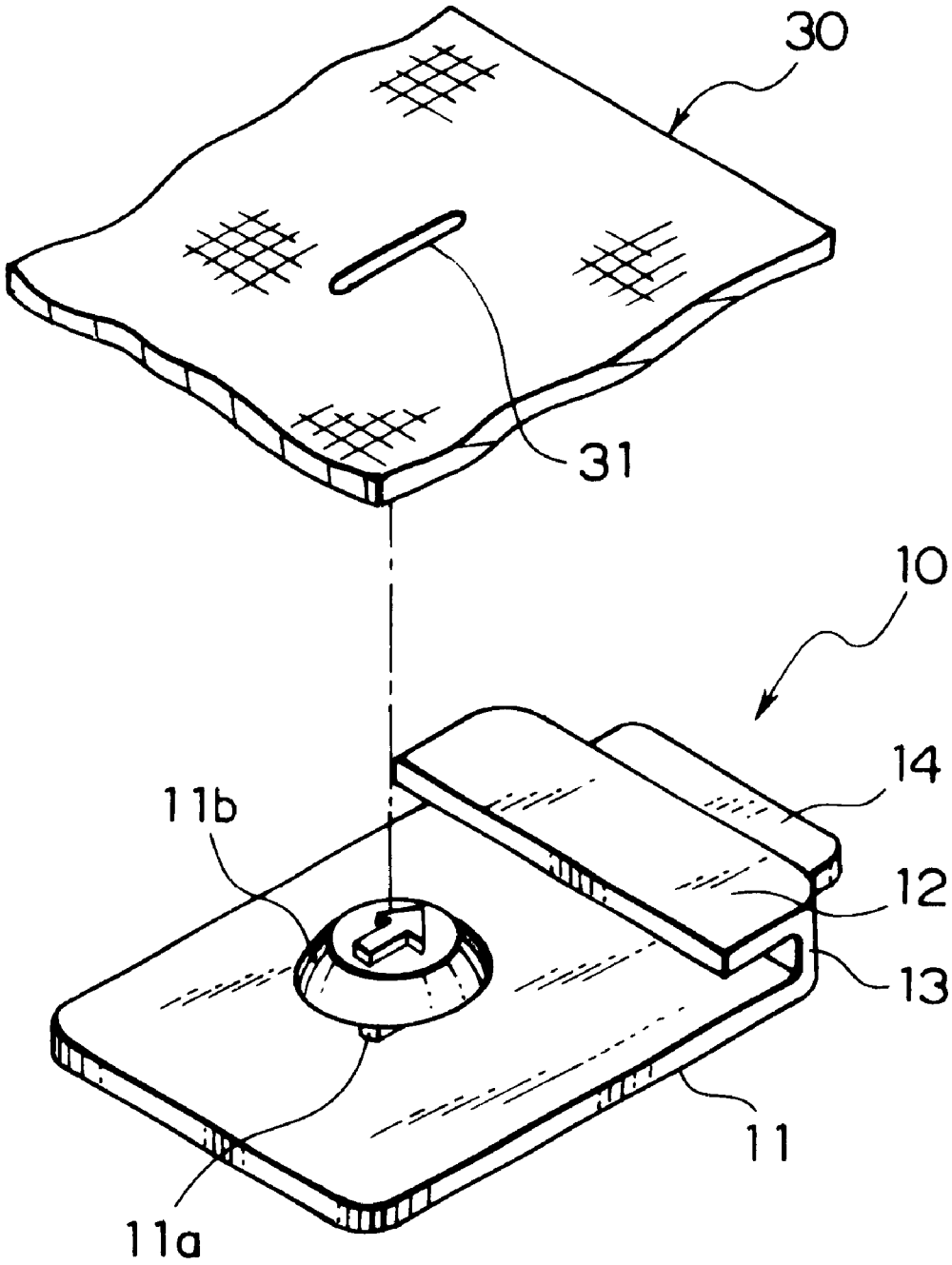
FIG. 1 is a three-dimensional view showing a state before attaching a press fastener according to a first embodiment of the present invention and an engaged piece that is a subject of its attaching.
Figure 2:
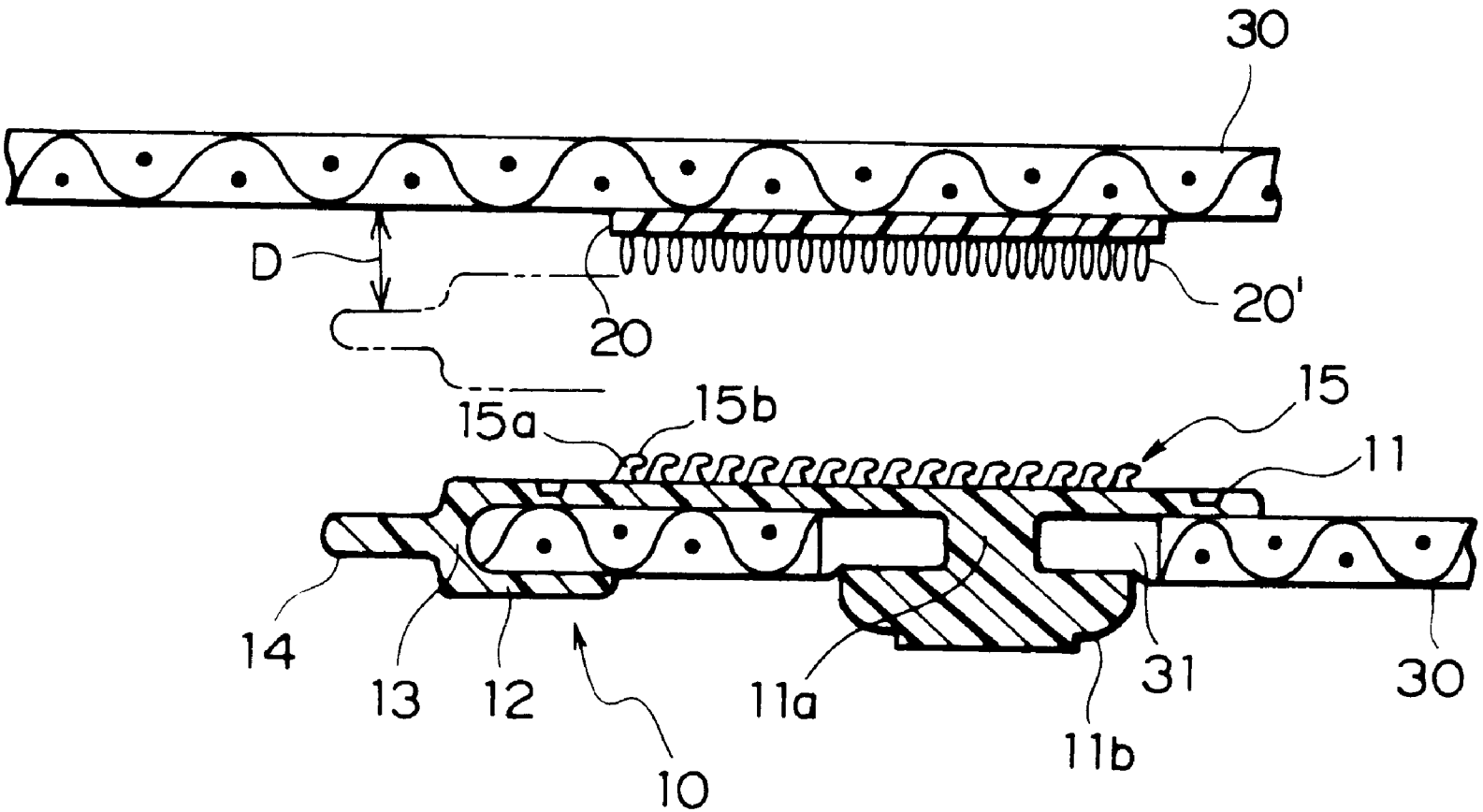
FIG. 2 is a view illustrating an operation of engaging the press fastener of FIG. 1 with a press fastener of the counterpart.
Figure 3:
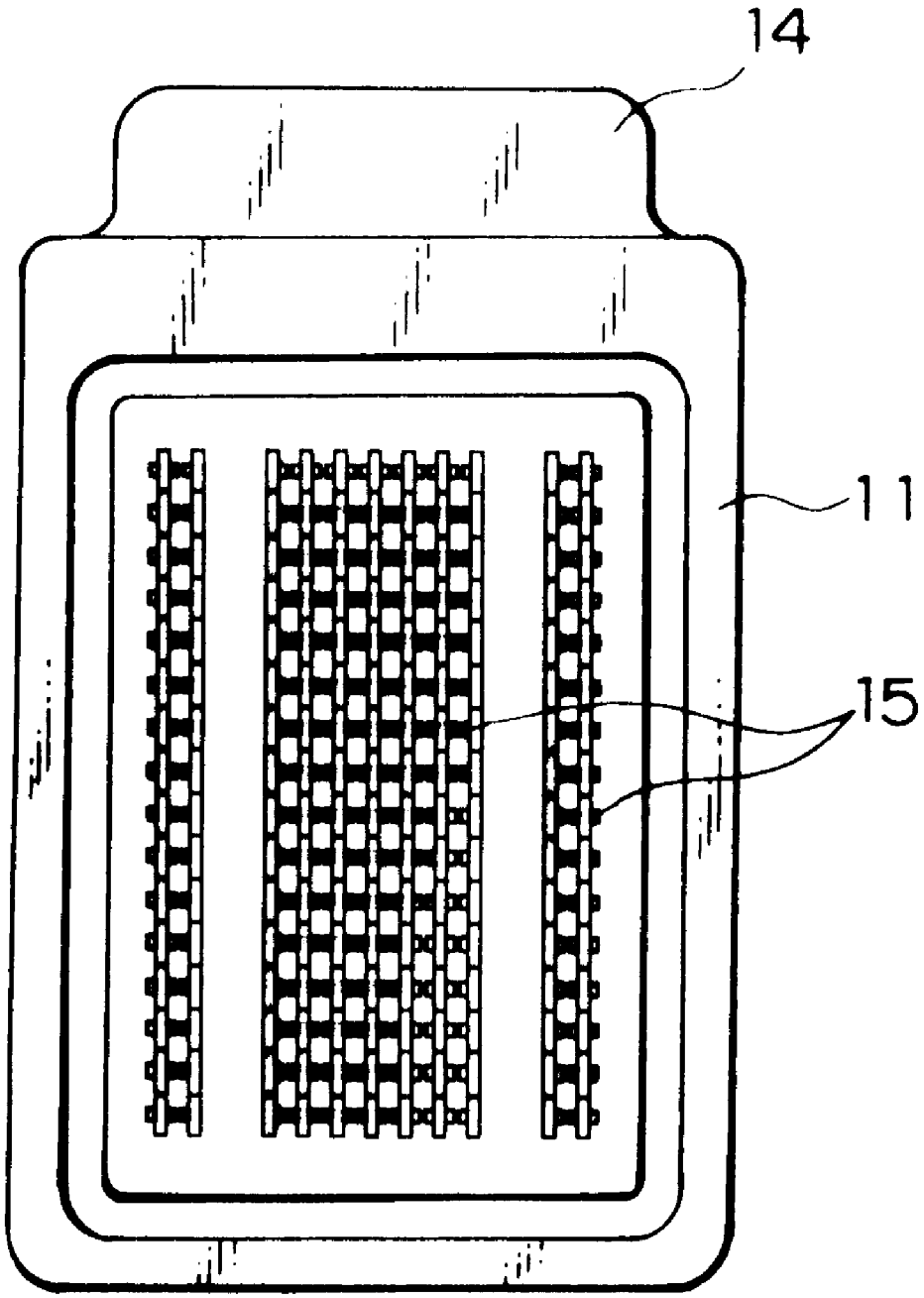
FIG. 3 is a plan view showing a rear side of the press fastener of FIG. 1.
Figure 4:
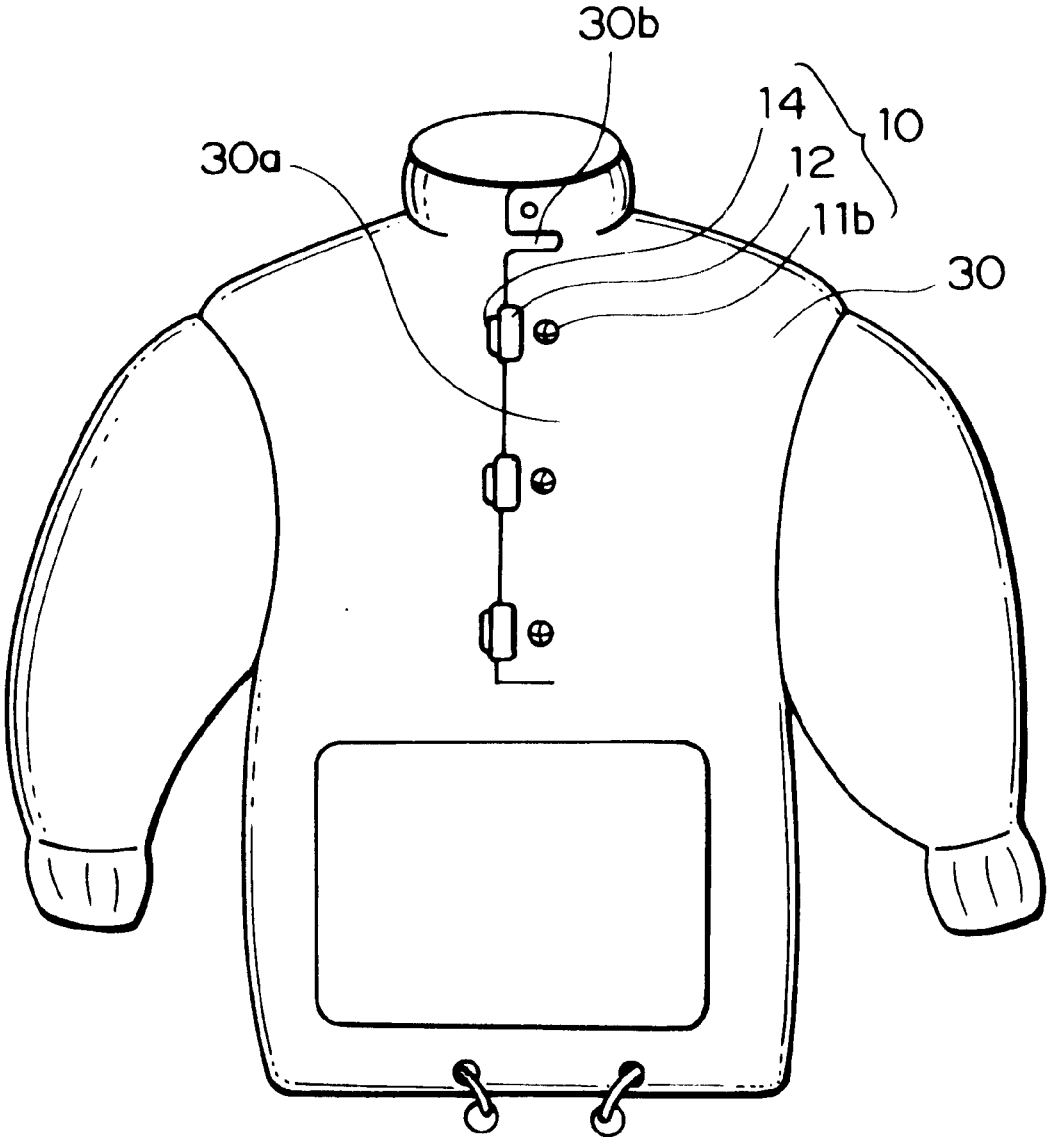
FIG. 4 is a front view showing a ski wear to which the press fastener is attached.

Hereinafter, the preferred embodiments of the present invention will be specifically described with reference to the illustrated embodiment. FIG. 1 is a perspective view showing a state before attaching an opening and closing press fastener according to a first embodiment of the present invention and an end edge attaching portion such as clothes being an attached body. FIG. 2 is a sectional view showing a relationship between an attaching state of the press fastener and a female surface fastener member of the counterpart, and FIG. 3 is a plan view showing the press fastener seen from a rear side. In addition, FIG. 4 is a front view showing an example of clothes to which the press fastener is attached.

An opening and closing press fastener 10 according to the illustrative embodiment has a substantially rectangle shaped rear side flat plate portion 11; a rectangle shaped front side flat plate portion 12 having a long side which is as long as a short side of the rear side flat plate portion 11 and consisting of a short side having a length which is substantially ⅕ of a long side of the rear side flat plate portion 11; and a connecting portion 13 for connecting the short side end edge of the rear side plate portion 11 to the long side end edge of the front side flat plate portion 12 in parallel to each other with a predetermined interval, and the entire side face shape is formed in a substantially J shape. According to this embodiment, the connecting portion 13 constitutes a positioning portion of the present invention for positioning the attaching end edge of an attached body 30 such as clothes. A pinch piece 14 parallel to both of the flat plate portions 11 and 12 is protruded outwardly at this connecting portion 13. The interval between the rear side and front side flat plate portions 11 and 12 is arbitrarily determined depending on the thickness of the attaching portion of the attached body 30 to which the press fastener 10 of the present invention is attached.

On the surface (rear face of the fastener 10) of the rear side flat plate portion 11, a number of engaging elements 15 are protruded in multiple arrays by integral molding as shown in FIG. 2 and FIG. 3. The engaging element 15 in this embodiment is formed in a hook shape having a rising portion 15*a* standing from the rear side flat plate portion 11 and an engaging portion 15*b* extending outwardly and curved from a tip end of the rising portion 15*a*, as shown in FIG. 2. In the shown example, all engaging portions 15*b* extend in the same directions. In addition, each of the hook shaped engaging elements 15 is formed such that tip end of the engaging portion 15*b* faces in a direction opposite to the protrusion direction of the pinch piece 14. Thus, as shown in FIG. 2, a strength of engagement with a surface fastener member 20 of the counterpart having a number of loops 20' is the strongest in a direction opposite to the extension direction of the curved engaging portion 15*b*. The extension direction of the engaging portion 15*b* can be oriented in an opposite direction in the adjacent arrays of each of the hook shaped engaging elements 15. In such a case, directivity in the strength of engagement with the surface fastener member 20 of the counterpart is eliminated.

In addition, the following construction is the most different from the press fastener proposed in the above described publication or prior application, and constitutes the characteristics of the present invention. At the center of the inner face of the rear side flat plate portion 11, pin members each having a disk shaped engaging head 11*b* are protruded and molded integrally at its tip end via a stem 11*a* of a rectangular cross section. It is preferable that a logo mark or a variety of decorative patterns is formed at an end face of this engaging head 11*b*. Although it is desirable that these patterns are formed at the same as when they are molded, it is possible to form them after they have been molded by a variety of welders or prints. In addition, a decorative pattern can be formed similarly on the surface of the front side flat plate portion 12 (front face of the press fastener).

On the other hand, a slit shaped engaging hole 31 for engaging the engaging head 11*b* is formed at the press fastener attaching portion of the attached body 30 such as clothes.

The opening and closing press fastener 10 according to the illustrative embodiment and of such construction, can be molded simply in a single process by means of injection molding, for example. That is, injection molding can be easily done by means of an injection mold in which cavities for molding the rear side flat plate portion 11, the number of engaging elements 15, the connecting portion 13; the stem 11*a*, and a part of the engagement head are formed at a movable die (not shown) by employing a split mold, and an insert mold is combined in a mating fixed mold, so that cavities for molding the external shape and decorative pattern of the front side flat plate portion 12, part of the connecting portion 13 and the disk shaped engaging head 11*b* are formed.

The cavities of the hook shaped engaging elements 15 cannot be engraved on a single mold surface because of its shape. Thus, the entire or partial shape of the cavity is formed at the end face of a plurality of thin plate materials, and is formed by laminating them in combination. In addition, during the molding, the elements can be directly pulled out from the hook shaped cavities by a releasing member such as an ejector pin (not shown). However, a plurality of the thin plate materials are spaced by proper means in the plate thickness direction, whereby they can be easily separated.

In order to attach the press fastener 10 of this embodiment comprising the above mentioned construction, as shown in FIG. 1 and FIG. 2, the pinch piece 14 is arranged at the outside of clothes, and the rear side at which the engaging elements 15 are protruded is provided at the inside of the clothes. For example, an upper front end edge 30*a* at a fly of a ski wear 30 as shown in FIG. 4 is pinched with both flat plate portions 11 and 12, and the engaging head 11*b* is engaged with the slit shaped engaging hole 31 to be temporarily fixed. On the other hand, at a lower front end edge 30*b* of the fly, as shown in FIG. 2, the female surface fastener member 20 of the counterpart having the number of loops 20' engaged with or disengaged from the fastener 10 corresponding to the attaching position of the press fastener 10 is attached by means of sewing, bonding or the like.

In the meantime, when the fastener attaching end edge of the upper front end edge 30*a* such as clothes is inserted between flat plate portions 11 and 12 of both of the front and rear sides of the press fastener 10 of the illustrative embodiment, the cross section is formed in the substantial J shape. Thus, like the press fastener according to the already described prior application, the upper front end edge 30*a* of clothes or the like can be easily inserted without widening its opening end. Moreover, its insert end edge is abutted against the internal wall face of the connecting portion 13 that is a positioning portion, whereby the condition and position of attachment of the press fastener 10 is automatically determined, and thus, the press fastener 10 can be attached neatly. Further, the pinch piece 14 extended outwardly from the connecting portion is provided, thus ensuring durability and opening/closing operability.

In the illustrative embodiment, the sectional rectangle shaped stem 11*a* having a long side portion along the longitudinal direction of the engaging hole 31 of the attached body 30 exists between the disk shaped engaging head 11*b* and the inner face of the rear side flat plate portion 11. Thus, when the engaging head 11*b* is engaged with the engaging hole 31, the press fastener 10 does not turn in the engaging hole 31 together with the connecting portion 13. Accordingly, the press fastener 10 does not slip off from the attached body 30. In addition, in order to remove the press fastener 10 from the attached body 30 intentionally, the press fastener 10 can be easily removed in the same manner as when a general button is removed from a button hole. Therefore, the press fastener 10 having preferable color and pattern of the wearer's preference can be freely selected at the time of wearing, and moreover, the fastener can be arbitrarily replaced with another one. In addition, the press fastener can be removed for washing or ironing.

FIG. 4 shows an appearance of the ski wear in which the opening and closing press fastener 10 of the present invention and the surface fastener member of the counterpart (not shown) are attached. When the above press fastener 10 of the embodiment is pressed toward the surface fastener member 20 of the counterpart, both of them are easily engaged with each other, and the fly shown in the figure is closed. At this time, according to this embodiment, the engaging portions 15*b* of all the hook shaped engaging elements 15 are oriented in opening direction. Thus, even if strong external force is applied to a slide direction in which the fly is opened, the loops 20' act to the shear direction of the rising portion 15*a* of the hook shaped engaging elements 15, i.e., to the direction in which the engaging strength is the greatest. Thus, the fly is not opened easily. In addition, in this closed state, as indicated by a phantom line in FIG. 2, a gap D is formed between the pinch piece 14 of the press fastener 10 and the lower front portion of the fly. Thus, finger can be easily inserted into the gap D, facilitating subsequent opening operation for releasing the press fastener 10 from the surface fastener 20 of the counterpart.

Further, in this embodiment, the hook shaped engaging element 15 may be formed not integrally with the surface of the rear side flat plate portion 11. A common fiber based surface fastener having its external shape similar to the front side flat plate portion 11 and having hooks of a general monofilament on the surface of the base cloth of a knitted material may be bonded onto a flat face of the rear side flat plate portion 11 with an adhesive, for example.

Figure 5:
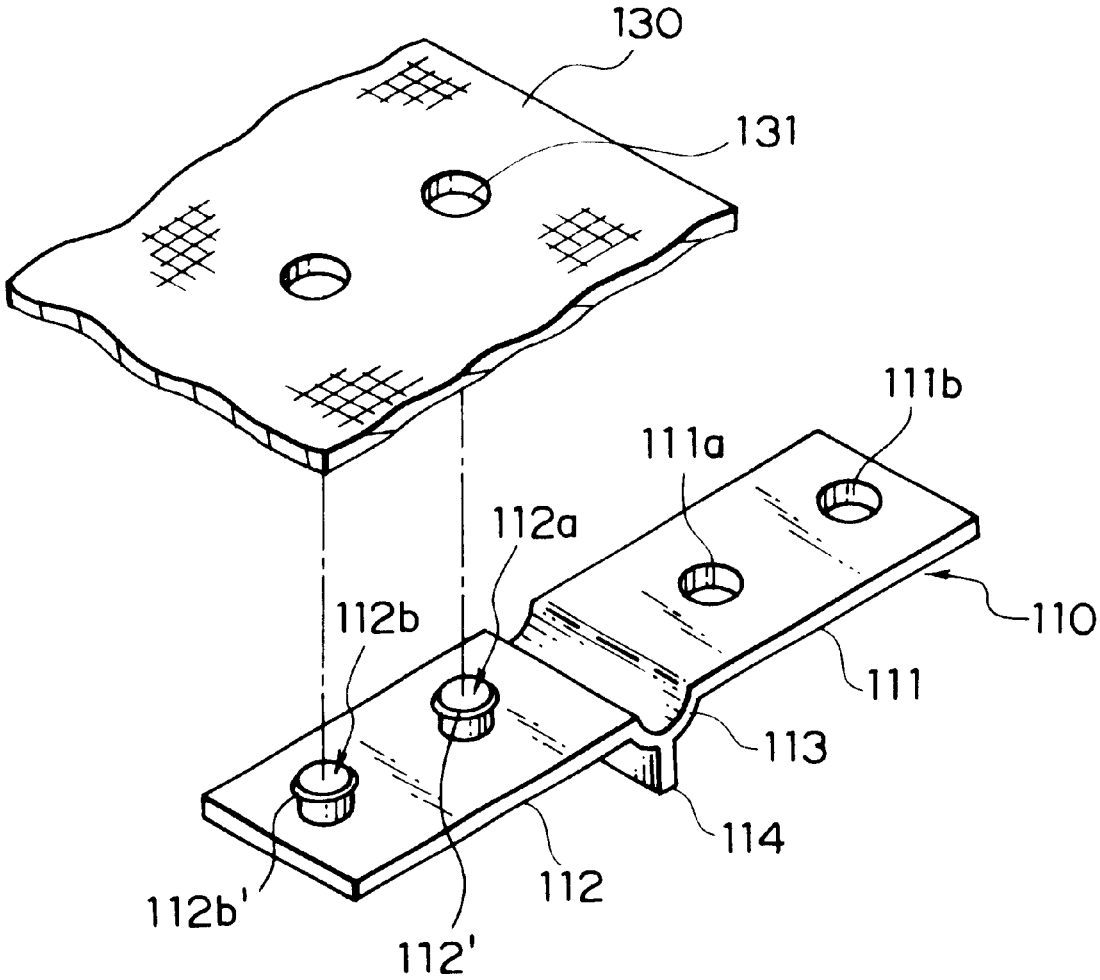
FIG. 5 is a three-dimensional view showing a state before attaching a press fastener according to a second embodiment of the present invention and an attached piece that is a subject of the attaching.
Figure 6:
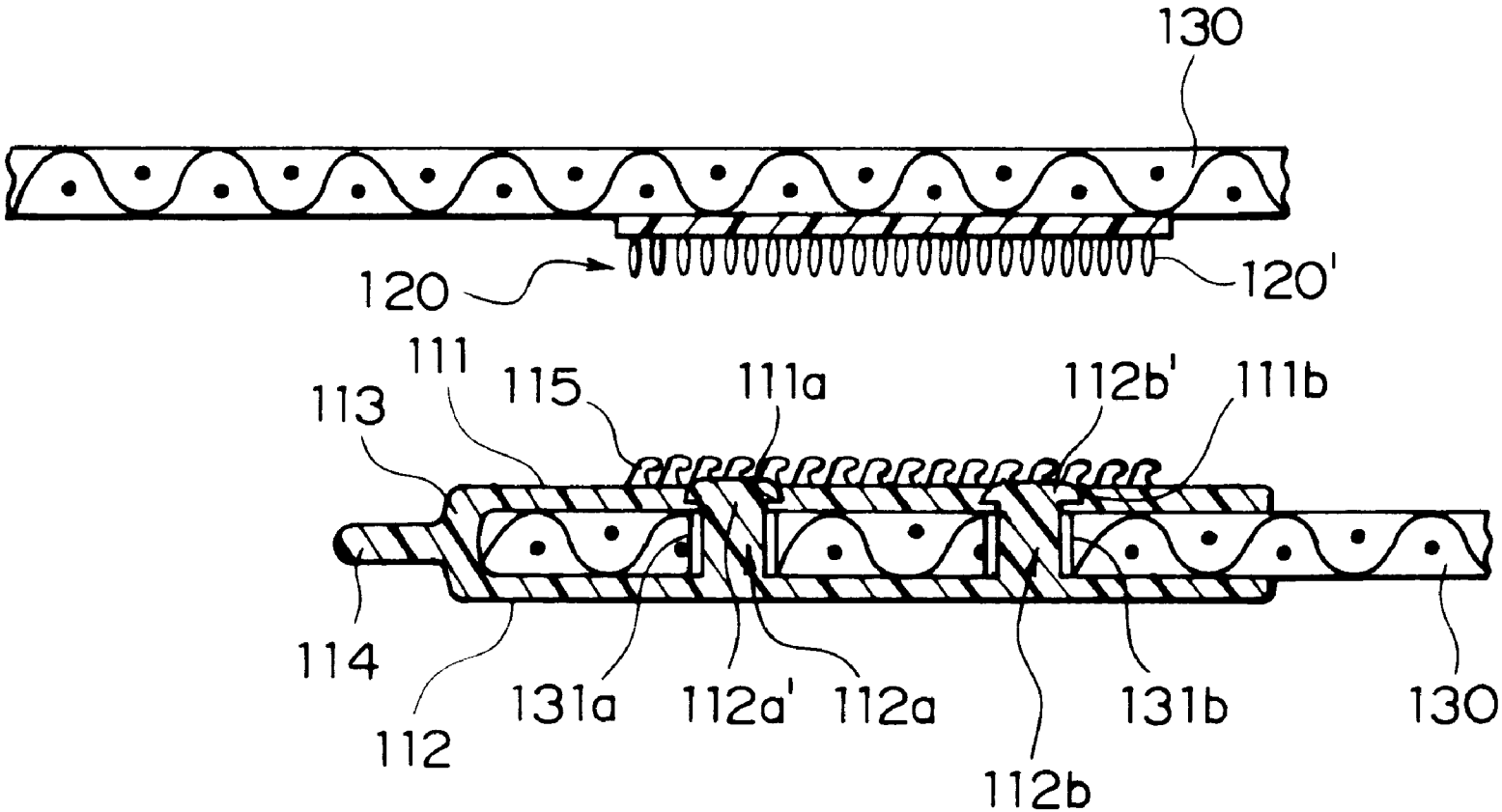
FIG. 6 is a view illustrating an operation of engaging the press fastener of FIG. 5 with the press fastener of the counterpart.

FIG. 5 and FIG. 6 are views each showing an attaching state of a press fastener 110 that is a second embodiment of the present invention. According to these figures, a rear side flat plate portion 111 and a front side flat plate portion 112 have the same rectangular shape. A connecting portion 113 serving as a positioning portion for connecting one side ends of the portions 111 and 112 has an arc shaped cross section. In addition, a flat plate shaped pinch piece 114 is extended outwardly linearly at the center of the connecting portion 113. Further, like the above illustrated embodiment, a number of hook shaped engaging elements 115 are molded integrally with the surface (rear face of the fastener 110) of the rear side flat plate portion 111.

Two pin engaging holes 111*a* and 111*b* are formed to penetrate with predetermined intervals in the longitudinal direction at the center in the widthwise direction of the rear side flat plate portion 111. At positions of the front side flat plate portion 112 corresponding to the pin engaging holes 111*a* and 111*b*, two engaging pins 112*a* and 112*b* having flange shaped engaging heads 112*a*' and 112*b*' at their tip ends are protruded to the rear side. Meanwhile, at the fastener attaching edge portion of an attached body 130 such as clothes, pin insertion through holes 131*a* and 131*b* through which the engaging pins 112*a* and 112*b* are penetrated when the fastener attaching edge portion is sandwiched with the flat plate portions 111 and 112 on the front and rear sides, are formed at positions corresponding to the pin engaging holes 111*a* and 111*b* and the engaging pins 112*a* and 112*b*.

In order to attach the press fastener 100 of this embodiment to the attached body 130 such as clothes, the press fastener 100 is bent in the substantial U shape, and the attached body 130 is inserted from the opening end of the fastener 100 until the end edge of the attached body 130 abuts against the bottom face of the connecting portion 113. Then, the flat plate portions 111 and 112 at the front and rear sides are pressed toward the mutually opposite face with fingertips or jigs. By means of this pressing operation, each of the engaging pins 112*a* and 112*b* are inserted into respective pin engaging holes 111*a* and 111*b* of the rear side flat plate portion 111 via the corresponding pin insertion through holes 131*a* and 131*b*, and each of the engaging heads 112*a*' and 112*b*' are resiliently deformed to be engaged with each of the pin engaging holes 111*a* and 111*b*. When the press fastener 110 is removed from the attached body 130, the above steps may be reversed. In this way, in this embodiment, the press fastener 110 can be easily attached to and removed from the attached body 130 with one touch operation.

In this embodiment as well, the hook directions of the hook shaped engaging elements are not necessarily coincident with each other as in the above embodiment. For example, the hook directions of the hook shaped engaging elements 115 arranged in the adjacent rows may be oriented in an opposite direction to each other. With such arrangement of the elements, necessary engagement force can be ensured in any direction at the fly.

A general fiber surface fastener having its external shape similar to the rear side flat plate portion 111 and having the aforementioned monofilament without molding the hook shaped engaging elements 115 integrally with the surface of the rear side flat plate portion 111 may be bonded integrally with the flat face of the rear side flat plate portion 111 with an adhesive.

Further, in this embodiment, the rear side flat plate portion 111 and the front side flat plate portion 112 are molded in its exploded state via the connecting portion 113. Therefore, in this case, in order to facilitate bending along the boundary between both of the flat plate portions 111 and 112 of the front and rear sides and the connecting portion 113, a groove for bending, i.e., a thin portion (not shown) may be formed.

Figure 7:
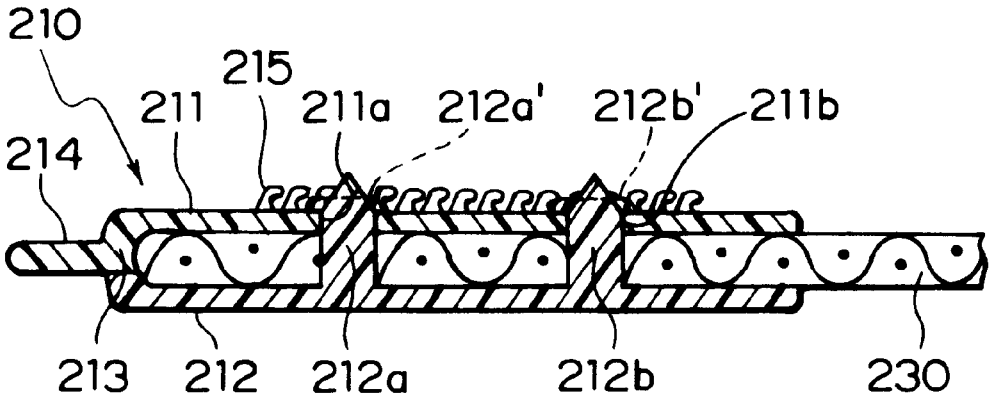
FIG. 7 is a fragmentary sectional view of an opening and closing fastener attached showing a modification of the second embodiment.

FIG. 7 shows a modification of the second embodiment. As is understood from the figure, this modification is greatly different from the foregoing embodiment in that the rear side flat plate portion 211 and the front side flat plate portion 212 are molded separately. The connecting portion 213, pinch piece 214, and hook shaped engaging elements 215 are molded integrally with the rear side flat plate portion 211. In addition, as in the foregoing illustrative embodiment, two engaging pins 212*a* and 212*b* are protruded at the rear side surface of the front side flat plate portion 212. As in the foregoing embodiment, two pin engaging holes 211*a* and 211*b* are formed at the rear side flat plate portion 211.

Further, this modification is different from the foregoing embodiment in shape of the engaging pins 212*a* and 212*b* at the time of molding. In the foregoing embodiment, each of the engaging pins 212*a* and 212*b* is formed to have the flange shaped engaging heads 212*a*′ and 212*b*′ at their tip ends from the first. In this modification, as indicated by solid line shown in FIG. 7, the engaging heads 212*a*′ and 212*b*′ are not molded during molding, and the through holes of the engaging pins 212*a* and 212*b* are not formed at an attached body 230.

In order to attach the press fastener 210 to the attached body 230, the fastener attaching end edge of the attached body 230 is inserted from the opening end of each of the flat plate portions 211 and 212 on the front and rear sides to be abutted against the inner face of the connecting portion 213. Then, the tip ends of the engaging pins 212*a* and 212*b* are inserted sequentially into the attached body 230 and the pin engaging hole 212*b* of the rear side flat plate portion 211. The lengths of the engaging pins 212*a* and 212*b* are set to be equal to the length enough for extending to the outside from the pin engaging holes 211*a* and 211*b* of the rear side flat plate portion 211, and their tip ends are sharply formed. The tip ends of the engaging pins 212*a* and 212*b* are formed to be sharp, and thus, the attached body 230 such as clothes can be pierced by their tip end. In this modification, no pin insertion through hole is formed at the attached body 230.

Therefore, in this modification, even if the pin insertion though hole of the attached body 230 is eliminated, the tip ends of the engaging pins 212*a* and 212*b* can be pierced into the attached body 230. Then, the engaging pins 212*a* and 212*b* are inserted sequentially into the attached body 230 and the pin engaging holes 211*a* and 211*b* of the rear side flat plate portion 211. Thereafter, the sharp tip ends of the engaging pins 212*a* and 212*b* are pressed while they are softened by heating or ultrasound. As indicated by the phantom line shown in the figure, the flange shaped engaging heads 212*a*′ and 212*b*′ are formed, and the press fastener 210 is attached to the temporarily fastened attached body 230.

As in this modification, when the engaging heads 212*a*′ and 212*b*′ are formed after the press fastener 210 has been temporarily attached to the attached body 230, the head forming process has to be added. However, the fastener molding die is simply structured without significant cost increase. As described previously, in this modification, there is employed a construction in which the press fastener 210 is not removed easily after the faster 210 has been attached to the attached body 230. In addition, each of the flat plate portions 211 and 212 with their different colors or shapes on the front and rear sides can be variously combined according to the colors of the front and rear sides of clothes, and a variety of appearances and designs can be achieved.

Figure 8:
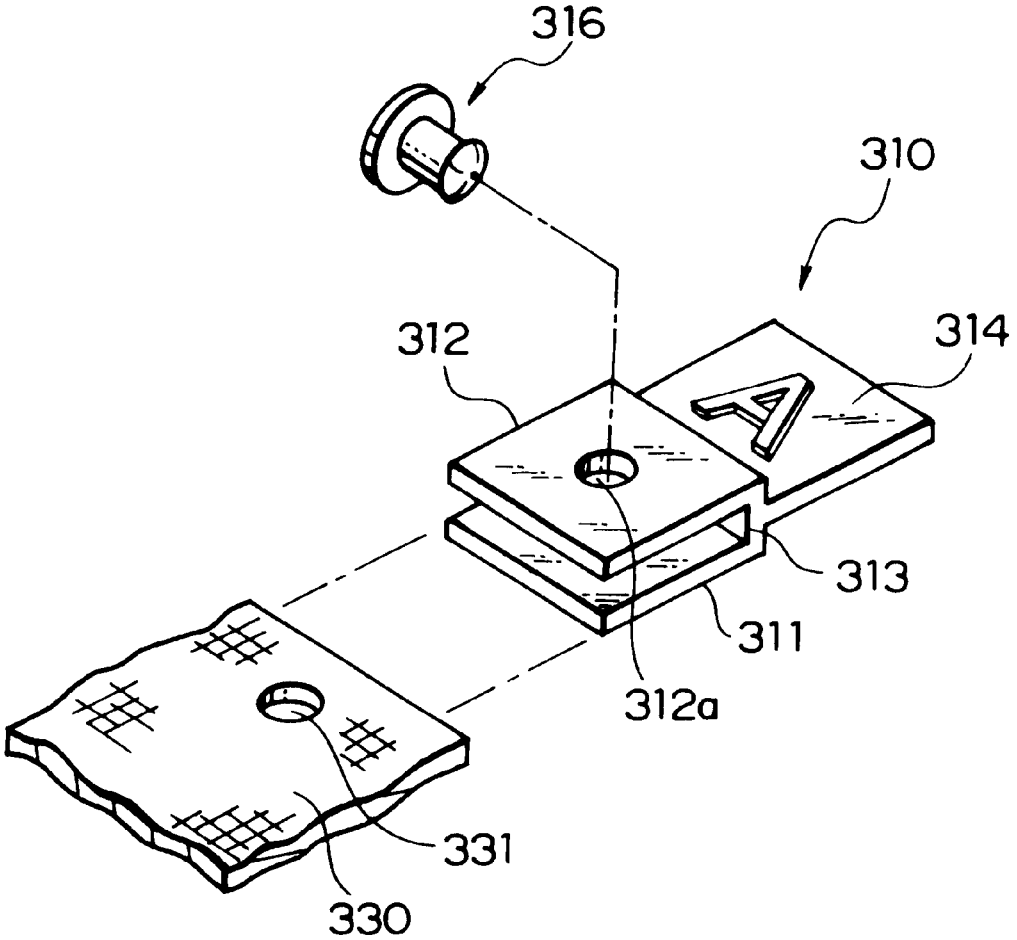
FIG. 8 is a three-dimensional view showing a state before attaching a press fastener according to a third embodiment of the present invention and an attached piece that is a subject of its attaching.
Figure 9:
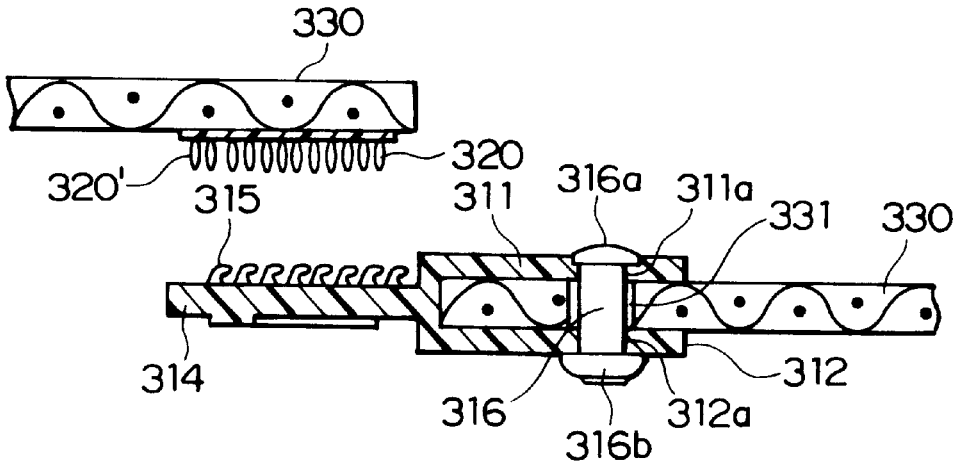
FIG. 9 is a view illustrating an operation of engaging the press fastener of FIG. 8 with a press fastener of the counterpart.

FIG. 8 and FIG. 9 each show a third embodiment of the present invention, wherein one end of the rectangle shaped rear side flat plate portion 311 is connected to one end of the front side flat plate portion 312 to be parallel to each other via a connecting portion 313. From the center of the connecting portion 313, a rectangular plate shaped press fastening portion 314 with its same width and length as each of the flat plate portions 311 and 312 is extended to the outside parallel to each of the flat plate portions 311 and 312. In this embodiment, an engaging pin 316 is molded independently of the front and rear side flat plate portions 311 and 312 and the connecting portion 313. The pin engaging holes 311*a* and 312*a* are formed respectively at the center of the flat plate portions 311 and 312 on the front and rear sides. A number of hook shaped engaging elements 315 is formed to be protruded on the rear face of the rectangular plate shaped press fastening portion 314, and a logo mark or various patterns and the like are formed on its front face.

On the other hand, a pin insertion through hole 331 is formed at the fastener attaching end edge of the attached body 330 such as clothes. Engaging heads 316*a* and 316*b* formed at both ends of the engaging pin 316 with the pin 316 being sandwiched between both of the flat plate portions 311 and 312 on the front and rear sides are engaged with the respective engaging holes 311*a* and 312*a* via the pin insertion through holes 331. Of the engaging heads 316*a* and 316*b* formed at both ends of the engaging pin 316, the engaging head 316*b* arranged on the front side is shaped in the same way as the general button. Various patterns are formed on its surface. The size of the head 316*b* is greater than that of the head 316*a* arranged on the rear side. The engaging head 316*a* arranged on the rear side is formed in a flange shape at the tip end of the engaging pin 316, and is engaged to be resiliently deformable relatively with respect to the pin engaging hole 311*a* on the rear side. In the shown embodiment, the pin engaging hole 311*a* is divided into a short diameter portion and a long diameter portion via a stepped portion, and the engaging head 316*a* is engaged with the short diameter portion.

In order to attach the press fastener 310 of the illustrative embodiment to the attached body 330 such as clothes, the attaching end edge of the attached body 330 is inserted from the opening end of each of the flat plate portions 311 and 312 on the front and rear sides of the press fastener 310 until the end edge of the attached body 330 is abutted against the bottom face of the connecting portion 313. Then, the small diameter engaging head 316*a* is inserted sequentially into the pin engaging hole 312*a* of the front side flat plate portion 312, the pin insertion through hole 331 of the attached body 330, and the pin engaging hole 311*a* of the rear side flat plate portion 311 so as to finally engage with the pin engaging hole 311*a*. When the press fastener 310 is removed from the attached body 330, the above steps may be reversed. In this way, in this embodiment, the press fastener 310 can be easily attached to or removed from the attached body 330 by inserting and removing operations of the engaging pin 316.

In this third embodiment, the engagement and disengagement with the engaging portion of the surface fastener of the counterpart is accomplished by means of a number of hook shaped engaging elements 315 formed on the rear face of the rectangle shaped plate shaped press fastener 314. That is, each of the flat plate portions 311 and 312 on the front and rear sides attached so as to sandwich the attached body 330 is not engaged with the engaging portion of the surface fastener of the counterpart by being pressed via the attached body 330. Instead, the rectangle shaped press fastening portion 314 is engaged by being directly pressed, and thus, reliable engagement can be obtained without pressing so strongly.

Figure 10:
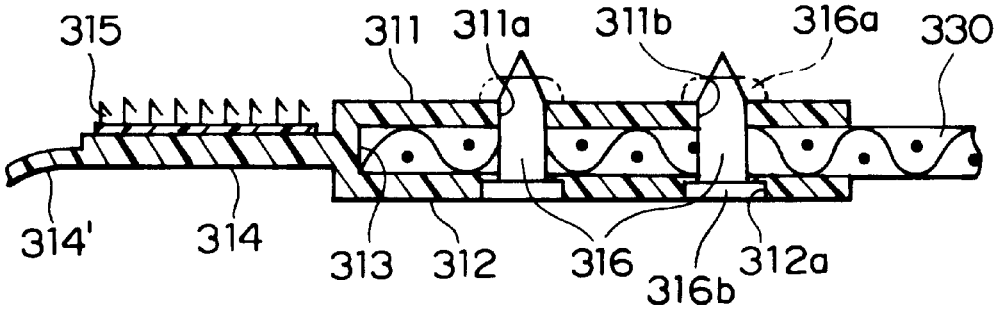
FIG. 10 is a cross sectional view of the press fastener attached showing a modification of the above embodiment.

FIG. 10 shows a first modification of the third embodiment. In this modification, as in the modification shown in FIG. 7, the small diameter engaging head 316*a* is formed from the engaging pin 316 in the third embodiment. In addition, the pin engaging holes 311*a* and 312*b* through which two engaging pins 316 and 316 are inserted are formed with predetermined intervals in a direction of insertion of the flat plate portions 311 and 312 with respect to the attached body 330. In the shown example as well, as in the modification shown in FIG. 7, the through hole of the engaging pin 316 is not formed at the attached body 330.

In order to attach the press fastener 310 to the attached body 330, the fastener attaching end edge of the attached body 330 is inserted from the opening ends of both of the flat plate portions 311 and 312 on the front and rear sides to abut against the inner face of the connecting portion 313. Then, the tip ends of the engaging pins 316, 316 are inserted sequentially into the pin engaging holes 312*a* of the front side flat plate portion 312, the attached body 330, and the pin engaging holes 311*a* of the rear side flat plate portion 311. The tip end of the engaging pin 316 is formed sharply. Thus, as in the modification shown in FIG. 7, its tip end can be pierced into the attached body 330 such as clothes so that the pin insertion through hole is not formed at the attached body 330. In addition, in this modification, the tongue piece shaped pinch piece 314' extends at the outside end edge of the press fastening portion 314, and the woven or knitted fiber female surface fastener having the hook shaped engaging elements 315 of monofilament is bonded to the rear face of the press fastening portion 314 by means of an adhesive.

In this modification as well, as in the modification shown in FIG. 7, even if a pin insertion through hole of the attached body 330 is eliminated, the tip end of the engaging pin 316 can be pierced into the attached body 330. Then, the engaging pin 316 is inserted sequentially into the pin engaging hole 312*a* of the front side flat plate portion 312, the attached body 330, and the pin engaging hole 311*a* of the rear side flat plate portion 311. Thereafter, the sharp tip end of the engaging pin 316 is pressed while it is softened by heating or ultrasound so that as indicated by phantom line shown in the figure, the flange shaped engaging head 316*a* is formed, and the press fastener 310 is attached to the temporarily fastened attached body 330.

Figure 11:
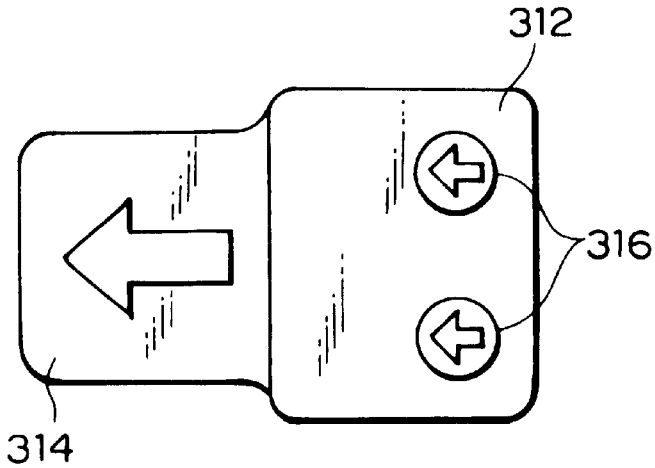
FIG. 11 is a plan view of a front side of the press fastener of FIG. 10 further showing its modification.

FIG. 11 shows a further modification of the press fastener 310 shown in FIG. 10. In the modification shown in FIG. 10, two pin engaging holes 311*a* and 312*a* formed at the flat plate portions 311 and 312 on the front and rear sides are formed with predetermined intervals in a direction of insertion of the attached body 330 into the press fastener 310 as described above. In this modification of FIG. 11, these two holes are formed in parallel to the connecting portion 313.

As is obvious from the foregoing description, in the press fastener of the present invention, various design change can occur within the scope of the claims without being limited to the aforementioned embodiments or modifications.

What is claimed is:

1. A synthetic resin opening and closing press fastener comprising: a front side flat plate portion and a rear side flat plate portion which are to be attached to an end edge of a flat plate shaped attached body, a positioning portion of the end edge of said attached body being provided on a part of said press fastener; and a number of engaging elements of a surface fastener on a surface of the rear side, wherein said opening and closing press fastener is attached to said attached body by means of a synthetic resin pin member having an engaging head at least at one end.

2. An opening and closing press fastener according to claim 1, wherein said front and rear side flat plate portions are integrally molded via said positioning portion.

3. An opening and closing press fastener according to claim 1, wherein said front and rear side flat plate portions are separate from each other.

4. An opening and closing press fastener according to claim 2, wherein said pin member is molded to be protruded integrally with an inner face of said front side flat plate portion or said rear side flat plate portion toward an inner face of a flat plate portion of a counterpart.

5. An opening and closing press fastener according to claim 4, wherein a surface area of said front side flat plate portion is set to be smaller than a surface area of said rear side flat plate portion, and said pin member is molded integrally with a rear face of the rear side flat plate portion at a position out of said front side flat plate portion toward the front side.

6. An opening and closing press fastener according to claim 2 or 3, wherein said pin member is separate from said front and rear side flat plate portions, and has an engaging head at both ends thereof.

7. An opening and closing press fastener according to claim 1, wherein said plurality of engaging elements are formed on the surface of said rear side flat plate portion.

8. An opening and closing press fastener according to claim 1, wherein the faster has a flat plate shaped press fastening portion substantially parallel to said front and rear side flat plate portions extending from said positioning portion to the outside, and said number of engaging elements are formed on a rear face of said press fastening portion.

9. An opening and closing press fastener according to claim 7 or 8, wherein said engaging element is made of synthetic resin, and is molded integrally with said opening and closing press fastener.

10. An opening and closing press fastener according to claim 7 or 8, wherein said engaging elements are a number of hook-shaped engaging elements formed of a loop of a monofilament woven or knitted into a foundation structure of a woven or knitted cloth, and said foundation structure are joined and fixed to said opening and closing press fastener.

* * * * *